US006208069B1

(12) United States Patent
Jüstel et al.

(10) Patent No.: US 6,208,069 B1
(45) Date of Patent: Mar. 27, 2001

(54) LOW-PRESSURE MERCURY DISCHARGE LAMP FOR TANNING

(75) Inventors: Thomas Jüstel; Hans Nikol; Cornelis R. Ronda, all of Aachen (DE); Dick Van Der Voort, Maarheeze; Cornelis J. Jalink, Eindhoven, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/208,509

(22) Filed: Dec. 9, 1998

(30) Foreign Application Priority Data

Dec. 19, 1997 (EP) ..... 97204031

(51) Int. Cl.[7] ..... H01J 1/62; H01J 63/04
(52) U.S. Cl. ..... 313/487; 313/486
(58) Field of Search ..... 313/485, 486, 313/487, 467, 468; 252/301.4 R, 301.4 F, 301.4 H

(56) References Cited

U.S. PATENT DOCUMENTS 4,703,224 10/1987 Rattray et al. ..... 313/487
4,859,903 * 8/1989 Minematu et al. ..... 313/487

* cited by examiner

*Primary Examiner*—Nimeshkumar D. Patel
*Assistant Examiner*—Joseph Williams
(74) *Attorney, Agent, or Firm*—Dicran Halajian

(57) ABSTRACT

A lamp vessel is made from a material which absorbs short-wave UV radiation. In addition, the luminescent screen comprises cerium-activated lunthanum phosphate and a luminescent substance having an emission band whose maximum is situated in the wavelength range from 340 nm and whose half-value ranges between 35 nm and 80 nm. The emission spectrum of the lamp for wavelengths below 400 nm corresponds closely to the solar spectrum while the lamp also has a high erythema L light output.

11 Claims, 2 Drawing Sheets

LOW-PRESSURE MERCURY DISCHARGE LAMP FOR TANNING

BACKGROUND OF THE INVENTION

The invention relates to a low-pressure mercury discharge lamp for tanning purposes, comprising a lamp vessel which is closed in a gastight manner and filled with mercury and one or more inert gases, a luminescent screen, means for maintaining a discharge in the lamp vessel, during operation of the lamp.

Such a low-pressure mercury discharge lamp, hereinafter also referred to as lamp, is known from U.S. Pat. No. 4,703,224. This lamp comprises a lamp vessel formed from an "open" glass having a relatively high transmission for UV-radiation of a relatively short wavelength. The luminescent screen of the known lamp comprises a mixture of cerium-activated strontium magnesium aluminate, europium-activated strontium pyrophosphate and europium-activated barium pyrophosphate. The emission spectrum of this luminescent screen for wavelengths below 400 nm corresponds substantially to the spectrum of sunlight. Since the UV-radiation acting on the skin is situated mainly in this wavelength range, the emission spectrum of the known lamp has biological effects which also correspond substantially to those of sunlight. More particularly, the lamp has advantageous properties as regards tanning and thickening of the skin so that an increased resistance against reddening of the skin caused by over-exposure to sunlight is brought about. A drawback of the known lamp, however, is that the luminescent substances included in the luminescent screen demonstrate a certain degree of optical interaction with each other, so that a part of the light emitted by these luminescent substances is absorbed again by the luminescent screen. This optical interaction causes a relatively low effectiveness of the lamp. Since the degree to which optical interaction occurs depends substantially on the thickness of the luminescent screen, and in practice this thickness varies relatively substantially within a lamp, the optical interaction causes relatively large differences between the emission spectra of different parts of the luminescent screen.

SUMMARY OF THE INVENTION

It is an object of the invention to provide a low-pressure mercury discharge lamp for tanning purposes whose emission spectrum for wavelengths below 400 nm corresponds substantially to the spectrum of sunlight, the lamp also having a relatively high effectiveness, and the difference between the emission spectra of different parts of the luminescent screen being relatively small.

According to the invention the lamp vessel is made of a short-wave UV radiation-absorbing material whose transmission for UV radiation with a wavelength of 312.6 nm ranges between 10% and 50% and whose wavelength range over which the transmission of the UV radiation changes from 20% to 80% is smaller than 40 nm and greater than 28 nm.

The luminescent screen includes a first luminescent material having an emission band with an emission maximum between 300 nm and 330 m and a half-value width of this emission ranging between 15 and 30 nm. and The luminescent screen further includes a second luminescent material whose reflection for UV radiation of a wavelength above 300 nm is more than 80%, and the material has an emission band with an emission maximum in the wavelength range from 340 nm to 370 nm, the half-value width of which ranges between 35 nm and 80 nm.

The absorption properties of the glass and the emission properties of the luminescent screen jointly bring about that the emission spectrum of the lamp for wavelengths below 400 nm corresponds substantially to the spectrum of sunlight. It has also been found that a lamp in accordance with the invention has a relatively high effectiveness and that there are only relatively small differences between the emission spectra of different parts of the luminescent screen.

It has been found that a very good correspondence between the solar spectrum and the emission spectrum of the lamp for wavelengths belonging to UV-B radiation is achieved if the first luminescent material includes cerium-activated lanthanumphosphate, hereinafter referred to as LAP, and, more particularly, if use is made of a lamp vessel whose transmission for radiation with a wavelength of 312.6 nm ranges between 30% and 40%.

Good results have been obtained with lamps in which the second luminescent material includes lead-activated bariumsilicate, hereinafter referred to as BSP. Good results have also been achieved with lamps in which the second luminescent material includes lead-activated strontium magnesium silicate, hereinafter referred to as SMS.

It proved possible to further increase the correspondence between the emission spectrum for wavelengths below 400 nm of such a lamp and the solar spectrum by adding a third luminescent material whose reflection for UV radiation having a wavelength above 300 nm exceeds 80%, said material having an emission band with an emission maximum between 370 nm and 400 nm and a half-value width in the range between 35 nm and 80 nm. It has been found that lead-activated barium strontium magnesium borate, hereinafter referred to as BMB, can very suitably be used as the third luminescent substance.

The solar spectrum varies with the altitude of the sun and hence with the location on earth where it is measured, and it is also influenced by atmospheric conditions. It has been found that the solar spectrum can very well be imitated under substantially varying conditions by means of low-pressure mercury discharge lamps in accordance with the invention including LAP and BSP, if the quantity of LAP ranges between 10 and 50% by weight of the luminescent screen. For low-pressure mercury discharge lamps in accordance with the invention including LAP and SMS, this proved to be the case if the quantity of LAP ranges between 3 and 40% by weight of the luminescent screen. In either case, the percentage of cerium in the LAP was approximately 10%.

It has also been found that in the case of lamps in accordance with the invention whose luminescent screen comprises LAP, BSP and BMB, a very good correspondence between the emission spectrum of the lamp and varying solar spectra could be achieved if the luminescent screen comprises between 10 and 40% by weight LAP and between 10 and 40% by weight BSP.

DETAILED DESCRIPTION OF THE PREFERRED EMBODIMENTS

Figure 1:
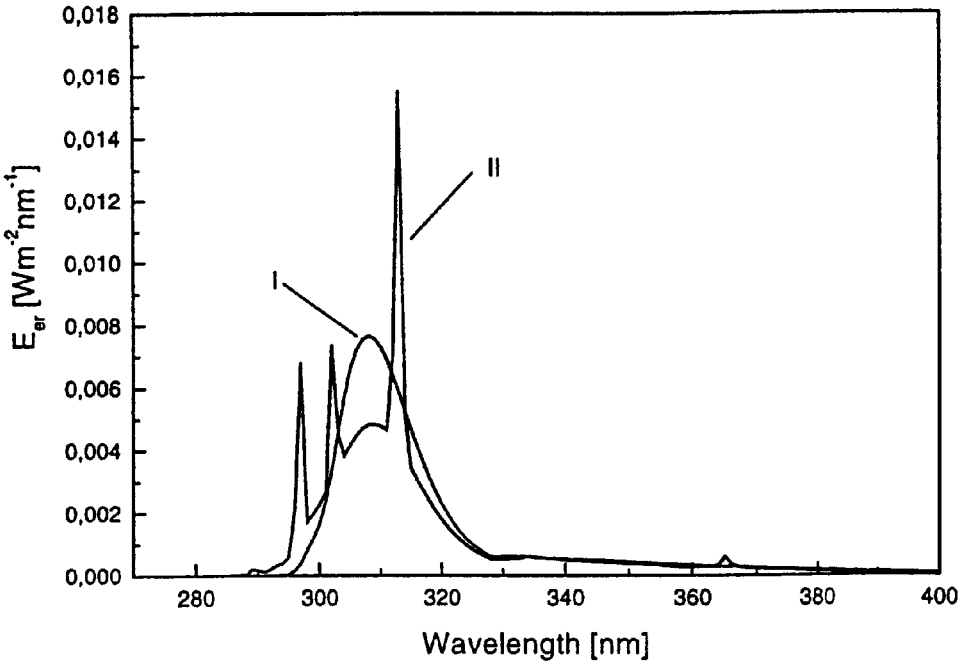
FIG. 1 shows the erythema L emission spectrum of a first low-pressure mercury discharge lamp in accordance with the invention, and the erythema-weighted spectrum of sunlight.
Figure 2:
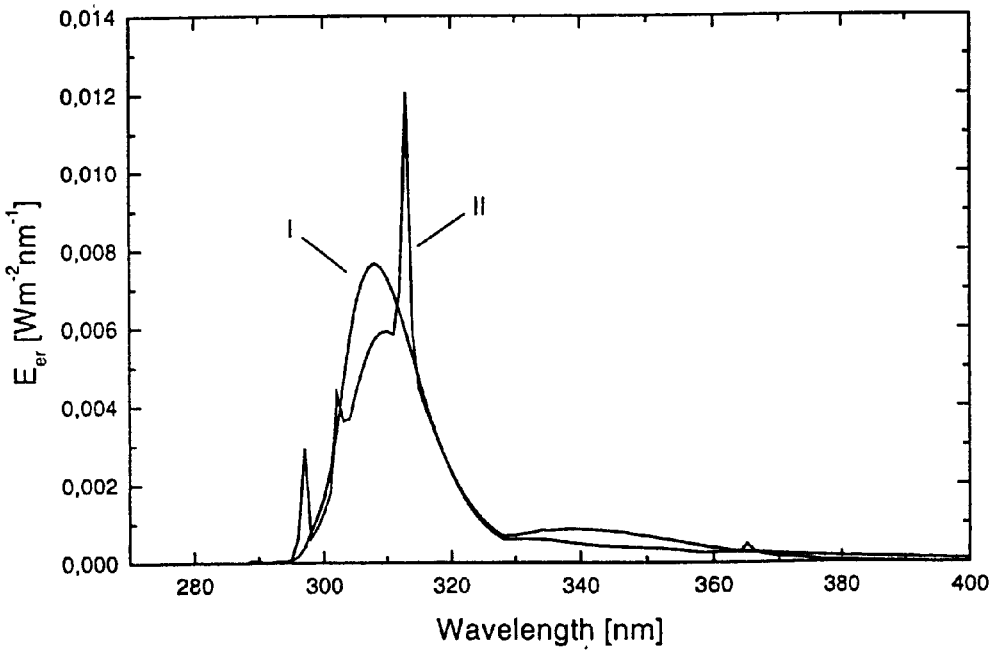
FIG. 2 shows the erythema L emission spectrum of a second low-pressure mercury discharge lamp in accordance with the invention and the erythema-weighted spectrum of sunlight.
Figure 3:
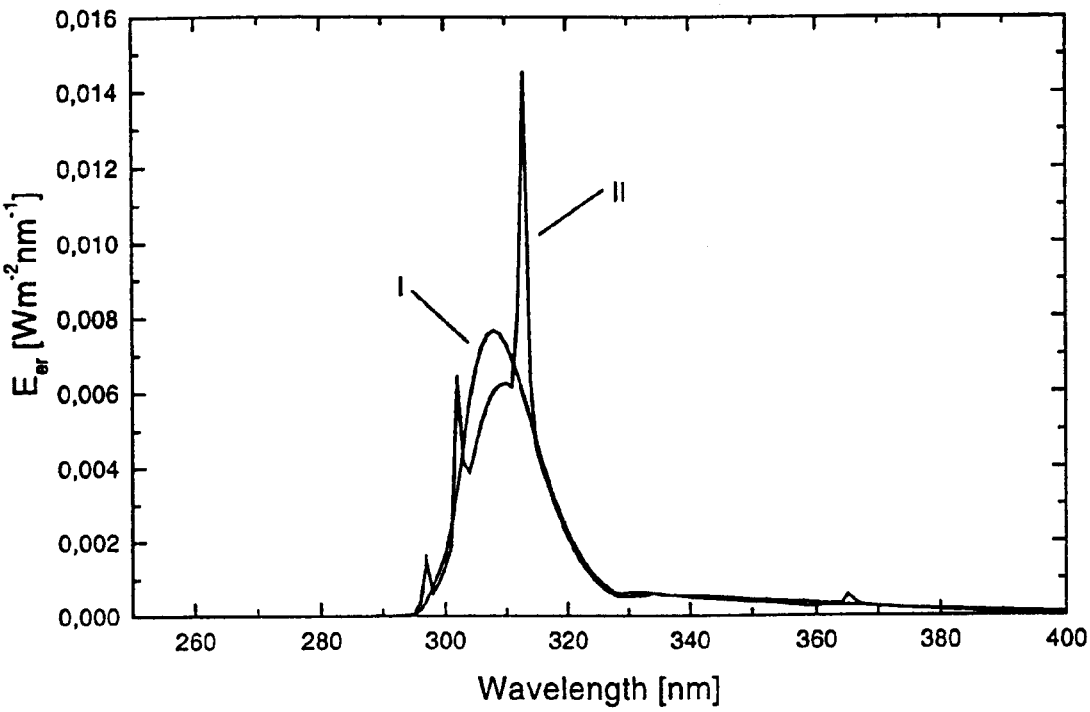
FIG. 3 shows the erythema L emission spectrum of a third low-pressure mercury discharge lamp in accordance with the invention and the erythema-weighted spectrum of sunlight.

In FIGS. 1 through 3, there is plotted along the horizontal axis, the wavelength in nm and along the vertical axis, the erythema-weighted radiation power or, in other words, the effective radiation power per unit of wavelength $E_{er}$ in $Wm^{-2}$ $nm^{-1}$. The effective radiation power per unit of wavelength is obtained by multiplying the power per unit of wavelength by the effectiveness of the relevant radiation for tanning. This effective radiation power per unit of wavelength as a function of the wavelength of the light emitted by a lamp constitutes the erythema-weighted emission spectrum of the lamp, which is indicated by curve 11 in each Figure. Curve I represents the erythema-weighted solar spectrum, the intensity of the radiation at each wavelength being multiplied by the effectiveness of UV radiation of this wavelength for tanning. The solar spectrum used was the Bjorn and Murphy spectrum which is based on a computer simulation as described by L. O. Bjorn in "Radiation Measurement in Photobiology", Academic Press, London, 1989, ed. B. L. Diffey. The Bjorn and Murphy spectrum simulates the solar spectrum for an altitude of the sun of 60 degrees. For each of the FIGS. 1–3, it applies that the overall effective power within the shown wavelength range from 280 nm to 400 nm of curve I is equal to that of curve II.

The lamps used were T8-type. The lamp vessel of the first, second and third low-pressure mercury discharge lamp was tubular and made from Philips 290 glass. This glass transmits UV radiation having a wavelength of 312.6 nm for approximately 35%. The wavelength range over which the transmission of the UV radiation changes from 20% to 80% is approximately 30 nm. The length of the lamp vessel was approximately 180 cm and the diameter 2.6 cm. Electrodes were provided at both ends of the lamp vessel, and a discharge was maintained between said electrodes during stationary operation of the lamp. The rated power consumed by the lamps was 70 Watt. The activation percentages of the LAP, BSP, SMS and BMB used were, respectively, approximately 10%, 1%, 1% and 2%. The emission maxima of the emission bands of the LAP, BSP, SMS and BMB used were, respectively, at 317 nm, 350 nm, 365 nm and 375 nm, and the half-value widths were, respectively 25 nm. 39 nm, 70 nm and 59 nm. The luminescent material BMB was obtained by mixing $BaCO_3$, $SrCO_3$, MgO and $H_3BO_3$ with PbO and, successively, heating this mixture to 900° C., grinding it and heating it again to 900° C. In this manner, BMB was obtained having the general formula $Ba_{1-x-y}Sr_xMg(BO_3)_2:Pb_y$, where $0<x<0.5$ and $0.001<y<0.05$. The formula of the BMB material used was approximately $Ba_{1,5}Sr_{0,-5}Mg(BO_3)_2$:1% $Pb^{2+}$. Each lamp contained 15 mg Hg and 2.2 mbar of a gas composed of 25% Ar and 75% Kr.

The luminescent screen of the first low-pressure mercury discharge lamp was composed of 4% by weight LAP and 96% by weight SMS. The luminescent screen of the second low-pressure mercury discharge lamp was composed of 26% by weight LAP and 74% by weight BSP. The luminescent screen of the third low-pressure mercury discharge lamp was composed of 12% by weight LAP, 30% by weight BSP and 58% by weight BMB. The coating weight was 2.8 $mg/cm^2$ for each of the three lamps. The overall quantity of effective (or erythema-weighted) UV radiation was 32.2 mW.

It can be observed that for the first low-pressure mercury discharge lamp the effective emission spectrum corresponds substantially to the effective solar spectrum. The ratio between the quantity of effective UV-B radiation (280 nm–320 nm) and the quantity of effective UV-A radiation (320 nm–400 nm) is approximately equal to that of the sun, and the same applies to the ratio between the quantity of effective UV-A1 radiation (340 nm–400 nm) and the quantity of effective UV-A2 radiation (320 nm–340 nm).

FIG. 2 shows that the effective emission spectrum of the second lowpressure mercury discharge lamp exhibits an even substantially greater correspondence to the effective solar spectrum. By integrating over the wavelength range shown the absolute difference in amplitude between the curves I and II and dividing it by the surface under curve I or curve II, it was found that the spectrum of the lamp deviates less than 4% from the Bjorn and Murphy spectrum. In this respect, it is noted that also the quantity of effective UV radiation (78.4 mW) supplied by this lamp is substantially higher than that of the first lamp.

FIG. 3 shows that the correspondence between the effective solar spectrum and the effective emission spectrum of the third low-pressure mercury discharge lamp has been further improved, particularly in the UV-A region, relative to the second low-pressure mercury discharge lamp. The overall quantity of effective UV-radiation (41.1 mW), however, is lower than that of the second lamp.

Apart from the above-mentioned Bjorn and Murphy spectrum, use has also been made of the Celled spectrum and the spectrum in accordance with DIN67501. The DIN67501 spectrum is also based on a computer simulation and simulates the solar spectrum in a place on the equator on which the sun shines down at a right angle. The DIN67501 spectrum is described in "Experimentelle Bewertung des Erythemschutzes von externen Sonnenschutzmitteln für die menschliche Haut" DIN67501, June 1996. The Sylt spectrum was experimentally determined on the island of Sylt in the North Sea on a dune top 10 meters above sea level on Jul. 11th, 1995 around noon. This spectrum is described in C. Stick et. al., Phys. Rehab. Kur. Med. 6, 1996, 1–6. Using exclusively LAP and BSP, lamps in accordance with the invention were manufactured which simulated the DIN67501 spectrum or the Sylt spectrum. The gas filling, the glass composition and the coating weight of these lamps corresponded to those of the lamps described hereinabove. The emission spectrum of these lamps most closely resembled the Sylt spectrum in the case where the luminescent screen contained 35% by weight LAP and 65% by weight BSP. The best correspondence between the emission spectrum of the lamps and the DIN67501 spectrum was found for lamps whose luminescent screen contained 46% by weight LAP and 54% by weight BSP. In the manner already described hereinabove, the absolute difference in amplitude between the erythema-weighted solar spectrum and the erythema-weighted lamp spectrum was integrated over the wavelength range from 280 nm to 400 nm, and the result was divided by the total erythema-weighted power of the solar spectrum in this wavelength range. In this manner, it was found that the lamp which best simulated this spectrum deviated less than 6% from the Sylt spectrum. The lamp which best simulated the DIN67501 spectrum deviated less than 7% from this DIN67501 spectrum.

What is claimed is:

1. A low-pressure mercury discharge lamp for tanning purposes, comprising:

a lamp vessel which is closed in a gastight manner and filled with mercury and one or more inert gases, wherein the lamp vessel is made of a short-wave UV radiation-absorbing material whose transmission for UV radiation with a wavelength of 312.6 nm ranges between 10% and 50% and whose wavelength range over which the transmission of the UV radiation changes from 20% to 80% is smaller than 40 nm and greater than 28 nm, a luminescent screen comprising a first luminescent material having an emission band with an emission maximum between 300 nm and 330 nm and a half-value width of this emission ranging between 15 and 30 nm, the luminescent screen further comprising a second luminescent material whose reflection for UV radiation of a wavelength above 300 nm is more than 80%, and said second luminescent material having an emission band with an emission maximum in the wavelength range from 340 nm to 370 nm, the half-value width of which ranges between 35 nm and 80 nm, and means for maintaining a discharge in the lamp vessel during operation of the lamp, wherein the lamp has an emission spectrum between 290 nm and 330 nm with a maximum value at said wavelength of 312.6 nm.

2. A low-pressure mercury discharge lamp as claimed in claim 1, in which the first luminescent material comprises cerium-activated lanthanum phosphate.

3. A low-pressure mercury discharge lamp as claimed in claim 2, in which the transmission of the lamp vessel for radiation with a wavelength of 312.6 nm ranges between 30% and 40%.

4. A low-pressure mercury discharge lamp as claimed in claim 2 wherein the cerium-activated lanthanum phosphate accounts for between 10 and 50% by weight of the luminescent screen, and the second luminescent material includes lead-activated barium silicate.

5. A low-pressure mercury discharge lamp as claimed in claim 2 wherein the cerium-activated lanthanum phosphate accounts for between 3 and 40% by weight of the luminescent screen, and the second luminescent material includes lead-activated strontium magnesium silicate.

6. A low-pressure mercury discharge lamp as claimed in claim 1, wherein the second luminescent material includes lead-activated barium silicate.

7. A low-pressure mercury discharge lamp as claimed in claim 1, wherein the lamp has an emission spectrum between 290 nm and 370 nm with a maximum value at said wavelength of 312.6 nm.

8. A low-pressure mercury discharge lamp for tanning purposes, comprising a lamp vessel which is closed in a gastight manner and filled with mercury and one or more inert gases, wherein the lamp vessel is made of a short-wave UV radiation-absorbing material whose transmission for UV radiation with a wavelength of 312.6 nm ranges between 10% and 50% and whose wavelength range over which the transmission of the UV radiation changes from 20% to 80% is smaller than 40 nm and greater than 28 nm, a luminescent screen comprising a first luminescent material having an emission band with an emission maximum between 300 nm and 330 nm and a half-value width of this emission ranging between 15 and 30 nm, the luminescent screen further comprising a second luminescent material whose reflection for UV radiation of a wavelength above 300 nm is more than 80%, and said second luminescent material having an emission band with an emission maximum in the wavelength range from 340 nm to 370 nm, the half-value width of which ranges between 35 nm and 80 nm, and means for maintaining a discharge in the lamp vessel during operation of the lamp, wherein the second luminescent material includes lead-activated strontium magnesium silicate.

9. A low-pressure mercury discharge lamp for tanning purposes, comprising a lamp vessel which is closed in a gastight manner and filled with mercury and one or more inert gases, wherein the lamp vessel is made of a short-wave UV radiation-absorbing material whose transmission for UV radiation with a wavelength of 312.6 nm ranges between 10% and 50% and whose wavelength range over which the transmission of the UV radiation changes from 20% to 80% is smaller than 40 nm and greater than 28 nm, a luminescent screen comprising a first luminescent material having an emission band with an emission maximum between 300 nm and 330 nm and a half-value width of this emission ranging between 15 and 30 nm, the luminescent screen further comprising a second luminescent material whose reflection for UV radiation of a wavelength above 300 nm is more than 80%, and said second luminescent material having an emission band with an emission maximum in the wavelength range from 340 nm to 370 nm, the half-value width of which ranges between 35 nm and 80 nm, and means for maintaining a discharge in the lamp vessel during operation of the lamp, wherein the luminescent screen further comprises a third luminescent material whose reflection for UV radiation having a wavelength above 300 nm exceeds 80%, said third luminescent material having an emission band with an emission maximum between 370 nm and 400 nm and a half-value width in the range between 35 nm and 80 nm.

10. A low-pressure mercury discharge lamp as claimed in claim 9, in which the third luminescent material comprises lead-activated barium stontium magnesium borate.

11. A low-pressure mercury discharge lamp as claimed in claim 10 wherein the luminescent screen comprises between 10 and 40% by weight of cerium-activated lanthanum phosphate as said first luminescent material and between 10 and 40% by weight of lead-activated barium silicate as said second luminescent material.

* * * * *